United States Patent [19]

Neukomm

[11] Patent Number: 4,606,384

[45] Date of Patent: Aug. 19, 1986

[54] GAS SUPPLY DEVICE INCLUDING A PLURALITY OF GAS FLASKS INSERTED IN A PRESSURIZED GAS CONTAINER

[75] Inventor: Peter A. Neukomm, Wettingen, Switzerland

[73] Assignee: Pewa Technic AG, Dietikon, Switzerland

[21] Appl. No.: 705,908

[22] Filed: Feb. 26, 1985

[30] Foreign Application Priority Data

Mar. 2, 1984 [CH] Switzerland ..... 1027/84

[51] Int. Cl.[4] ..... B67C 9/00

[52] U.S. Cl. ..... 141/329; 141/19; 141/363; 251/12

[58] Field of Search ..... 141/4, 19, 329, 330, 141/363; 169/86, 88; 222/5; 251/12

[56] References Cited

U.S. PATENT DOCUMENTS 2,585,039 2/1952 Rooke ..... 169/9
2,752,067 6/1956 Kohl et al. ..... 141/363 X
2,786,599 3/1957 Higbee ..... 141/330 X
4,224,994 9/1980 Tone et al. ..... 169/88 X
4,500,014 2/1985 Zimmerly ..... 222/5

*Primary Examiner*—Stephen Marcus
*Assistant Examiner*—Mark Thronson
*Attorney, Agent, or Firm*—Werner W. Kleeman

[57] ABSTRACT

A gas supply device contains a pressurized gas container having a plurality of inserted pressure-resistant gas flasks. The gas flasks are partially filled with liquid gas, such as carbon dioxide or nitrous oxide, before being inserted and are closed by an openable closure component. Each closure component of the gas flasks has associated with it an opening device effective at initiation of operational readiness of the gas supply device, at least one of which opening devices opens its associated closure component under the influence of an external force. It is possible to actuate the opening devices associated with the second gas flask and with further gas flasks by the gas escaping from the first opened gas flask. This gas supply device is especially suitable for applications where a large storage capacity is desired.

20 Claims, 16 Drawing Figures

GAS SUPPLY DEVICE INCLUDING A PLURALITY OF GAS FLASKS INSERTED IN A PRESSURIZED GAS CONTAINER

BACKGROUND OF THE INVENTION

The present invention broadly relates to a gas supply device and, more specifically, pertains to a new and improved construction of a gas supply device including a plurality of gas flasks or cartridges inserted in a pressurized gas container.

Generally speaking, the gas supply device of the present invention comprises a plurality of gas flasks or cartridges inserted into a pressurized gas container. In an operational position, the pressurized gas container is gas-tightly connected to a connection location and the interior of each gas flask or cartridge flow communicates with the interior of the pressurized gas container through a small aperture serving as a throttling orifice.

In other words, the gas supply device of the present invention comprises a pressurized gas container having an interior space and an operational position; a connection location for the pressurized gas container; a plurality of gas flasks inserted into the pressurized gas container; hermetic means for gas-tightly connecting the pressurized gas container to the connection location when the pressurized gas container is in the operational position; and each gas flask having an interior space flow communicating with the interior space of the pressurized gas container through a small aperture serving as a throttling orifice.

A gas supply device of the initially mentioned type is known from the German Pat. No. 712,559. This patent discloses a pressurized gas container exposed to artillery or gun fire in service. A plurality of closed gas flasks each provided with a relatively small opening are inserted next to one another in the pressurized gas container. This arrangement prevents the entire content from suddenly escaping at one location when the pressurized gas container bursts. The gas escapes from the inserted gas flasks through the relatively small openings into the burst pressurized gas container. The throttled content of the gas flasks can only escape relatively slowly through the small openings. The gas flasks are firmly seated in the pressurized gas container and can be extremely thin-walled in this arrangement. This, however, entails the danger that the inserted gas flasks may also burst when the pressurized gas container bursts. Furthermore, this pressurized gas container is only suited for a purely gaseous filling. The employment of liquid gas, which would provide an increase of the storable gas quantity, is not envisioned. The quantity of gas stored in this gas supply device is relatively modest.

A gas supply device for a liquid gas engine having a liquid gas container is known from the German Patent Publication No. 2,700,727. This pressurized gas container either comprises a commercially available carbon dioxide cartridge which partially contains liquid gas and is closed by a membrane or comprises a permanently installed gas container which must be filled with liquid gas. If the running time of the liquid gas engine is to be increased, a larger container must be selected. Safety regulations, however, require heavier and more expensive construction of larger pressurized gas containers. The content of commercially available carbon dioxide cartridges is a given quantity, i.e. is predetermined.

In this prior art gas supply device, the pressurized gas container is in thermally conductive communication with a container for a heat-storage substance. The heat-storage substance inserted therein is intended to prevent the progressive diminution of gas pressure while the gas escapes from the gas flask or cartridge. The pressure drop is a result of the cooling of the gas in the transition from the liquid to the gaseous state in the gas flask or cartridge. The heat-storage substance must be heated sufficiently far above the freezing point or crystallization temperature before operation. Otherwise it remains ineffective. The thermal conductivity of the heat-storage substance is very low, especially in the solid state. Therefore this substance can only be applied in relatively thin layers, e.g. 0.5 mm. The heat release and heat absorption time must be chosen sufficiently long, a matter of minutes. For this reason, the heating of the gas flask by a heat-storage substance is unsatisfactory.

SUMMARY OF THE INVENTION

Therefore, with the foregoing in mind, it is a primary object of the present invention to provide a new and improved construction of a gas supply device which does not exhibit the aforementioned drawbacks and shortcomings of the prior art constructions.

Another and more specific object of the present invention aims at providing a new and improved construction of a gas supply device of the previously mentioned type which displays a relatively great storage capacity, is suitable for the storage of partially liquid gas with simply initiatable operational readiness and with good operating characteristics and which has an economically advantageous design.

Yet a further significant object of the present invention aims at providing a new and improved gas supply device of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the gas supply device of the present invention is manifested by the features that the gas flasks or cartridges inserted into the pressurized gas container are pressure-resistant. Each gas flask is partially filled with a liquid gas before being inserted into the pressurized gas container and is closed by an openable or releasable closure component. An opening device effective at initiation of operational readiness of the gas supply device is associated with each openable closure component when the pressurized gas container is connected to the connection location. At least one opening device opens the associated openable closure component under the influence of an external force.

In other words, the present invention is manifested by the features that each gas flask is pressure-resistant and partially filled with a liquid gas before being inserted into the pressurized gas container; an openable closure component for closing each gas flask; an opening device associated with each openable closure component and effective at initiation of a state of operational readiness of the gas supply device when the pressurized gas container is connected and gas-tightly sealed to the connection location; and at least one of the opening devices being structured to open a therewith associated openable closure component under the influence of an external force.

The pressurized gas container can be tubular and the gas flasks or cartridges can be inserted thereinto in sequential arrangement while leaving a radial gap free. The mean width of the radial gap advantageously lies between 2% and 20% of the diameter of the gas flask or cartridge.

The end containing the openable closure component of at least the gas flask or cartridge lying closest to the connection location can be oriented remote from the connection location. The ends supporting the openable closure components of at least two gas flasks comprising an odd ordinal number and a subsequent even ordinal number, as counted from the connection location, advantageously confront one another in paired arrangement.

The gas flasks or cartridges can also be inserted into the pressurized gas container at least next to one another. It is particularly advantageous for a plurality of axially aligned gas flasks or cartridges having their ends containing the openable closure components confronting one another to be inserted into the pressurized gas container next to one another in tandem pairs.

The opening device can be translatably inserted into the pressurized gas container and provided with at least one pin or needle. It is advantageous to arrange an opening device provided on both sides with at least one pin or needle between two gas flasks oriented with their ends containing the openable closure components confronting one another. The opening device can be made of a blank of sheet metal. The opening device can comprise a plurality of guide tabs bent out of the plane of the blank of sheet metal in at least one direction and with such opening device engaging the inner wall of the pressurized gas container. The opening device may also comprise at least one pin or needle bent out of the plane of the blank of sheet metal in at least one direction for either pushing open or puncturing the associated openable closure component.

The pressurized gas container can be equipped with a tightening device which pushes the gas flasks or cartridges and the opening devices together for facilitating the initiation of operational readiness. The tightening device can comprise two partial tightening devices acting in temporal sequence, the first partial tightening device being effective only until the openable closure component of the first gas flask opens and the second being effective until the openable closure components of the remaining gas flasks or cartridges open. The first partial tightening device is actuatable from the exterior under the influence of an external force and the second partial tightening device is actuatable by the gas escaping from the first opened gas flask or cartridge. The first partial tightening device is preferably constituted by the fastening or connection means of the pressurized gas container to the connection location.

For gas flasks or cartridges closed by closure membranes or seals, the second partial tightening device advantageously comprises semi-sealing pistons separating the gas chambers or spaces of the individual gas flasks or cartridges and translatably guided in the pressurized gas container. The piston surfaces immediately confronting the closure components of the gas flasks or cartridges are provided with pins or needles serving to open the closure components. Two semi-sealing pistons guided in the tubular pressurized gas container which are spaced apart by a spring and support pins or needles on the side remote from the spring can be inserted between the mutually confronting ends of the gas flasks or cartridges containing the closure component and, at the other abutting locations of the gas flasks or cartridges, a single semi-sealing piston can be inserted. The pins or needles can be hollow and can open into the intermediate space between the two spaced pistons.

The second partial tightening device can also comprise a space or chamber arranged in the interior of the pressurized gas container which is filled with a compressible medium and is gas-tightly closed by a wall member which at least partially yields under pressure variations in the interior of the pressurized gas container. The wall member is partially supported in the pressurized gas container and the portion of the wall member yielding in relation to the wall member as a whole moves under a pressure increase in the pressurized gas container toward the gas flasks or cartridges and the opening devices and effects a pushing-together thereof. The wall member supported in the pressurized gas container can comprise a cylinder formed in a larger piston which is gas and liquid-tightly guided in a closed end region of the pressurized gas container. The yielding portion of the wall member can comprise a smaller piston which is gas and liquid-tightly guided in the cylinder. This smaller piston can be provided with a plunger having a considerably smaller diameter than the cylinder. The plunger serves for pushing together the gas flasks or cartridges and the opening devices and is provided on region of the pressurized gas container. The plunger is the side of the smaller piston remote from the closed end gas-tightly guided out of the cylinder chamber or space. The chamber or space lying between the closed end region of the pressurized gas container and both piston surfaces confronting this end region is filled with an incompressible fluid.

It is advantageous for the heating of the gas for the pressurized gas container to comprise a material of high thermal conductivity and high specific heat, for instance aluminum. It is also advantageous for the mass of the pressurized gas container to be at least seven times higher than the mass of the quantity of gas storable in the gas flasks or cartridges.

The pressurized gas container is advantageously provided with ribs or fins on its exterior surface. Optimal results can be obtained when the surface of the pressurized gas container exposed to air or swept by air, including the ribs or fins, comprises at least twenty square centimeters per gram of gas storable in the gas flasks or cartridges.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
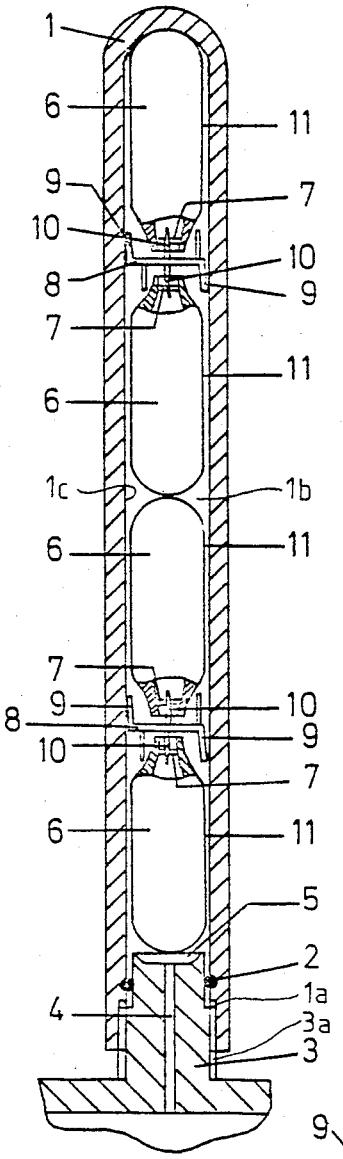
FIG. 1 schematically shows in cross-section a gas supply device having four sequentially arranged gas flasks.

Describing now the drawings, it is to be understood that to simplify the showing thereof only enough of the structure of the gas supply device has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a pressurized gas container 1 which in turn comprises a tube or substantially tubular housing closed at one end and provided with an O-ring 2 and an internal or female thread 1*a* at the other end.

The pressurized gas container 1 is screwed onto a connection location 3 having an exterior or male thread 3*a*. The connection location 3 has a communicating bore 4 which conducts the gas from the pressurized gas container 1 to a not particularly shown gas consuming device or gas consumption point. The end of the connection location 3 opening into the pressurized gas container 1 comprises a transverse slot 5 connecting the bore 4 with the interior space or chamber 1*b* of the pressurized gas container 1.

Four gas flasks or cartridges 6 are inserted into the interior space or chamber 1*b* of the pressurized gas container 1 in longitudinally sequential arrangement. The gas flasks or cartridges 6 preferably comprise commercially available steel carbon dioxide cartridges employed for household purposes which are partially filled with liquid gas before use and are closed by a closure membrane or seal 7. Cartridges filled with nitrous oxide are also commercially available and can equally well be employed for the gas supply device.

The gas flask or cartridge 6 lying closest to the connection location 3 is arranged such that its end containing the openable closure membrane 7 is remote from the connection location 3. Due to the transverse slot 5 on the end face of the connection location 3, the gas from the interior space 1*b* of the pressurized gas container 1 can enter through the support location of the gas flask bottom into the bore 4 leading to the gas consuming device. The first and second gas flasks or cartridges 6, as counted away from the connection location 3, as well as the third and fourth, are disposed in pairs with their ends containing the closure membranes 7 confronting one another.

Figure 2:
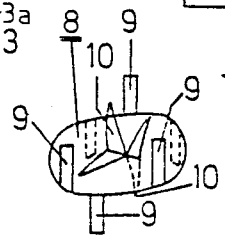
FIG. 2 schematically shows an opening device in perspective view.

An opening device 8 is inserted between the ends of the gas flasks or cartridges 6 which confront one another and contain the openable closure membranes 7. The opening device 8 is illustrated in FIG. 2 in perspective view on an enlarged scale. The opening device 8 is fabricated from a blank of sheet metal by punching and bending and comprises a plurality of guide tabs 9 bent perpendicular to the plane of the blank of sheet metal and two pins or needles 10 bent out of the plane of the blank of sheet metal at its center for puncturing the closure membrane 7.

At initiation of operational readiness, a gas flask or cartridge 6 is inserted with its opening upward into the open pressurized gas container 1 unscrewed from the connection location 3. Then an opening device 8 and subsequent another gas flask or cartridge 6 with its opening downward are inserted, thereafter another gas flask or cartridge 6 with its opening upward, an opening device 8 and finally a gas flask or cartridge 6 with its opening downward. Finally, the pressurized gas container 1 is screwed onto the connection location 3. When tightening the threaded connection 1*a*, 3*a* between the pressurized gas container 1 and the connection location 3, the gas flasks or cartridges 6 are pushed together and the pins or needles 10 puncture the closure membranes 7.

After the closure membranes 7 have been punctured, the gas can flow out of the gas flasks or cartridges 6 into the interior space 1*b* of the pressurized gas container 1. A radial gap 11 exists between the gas flasks or cartridges 6 and an inner wall 1*c* of the interior space 1*b* of the pressurized gas container 1. The gas can flow through this radial gap 11 into the transverse slot 5 and the bore 4 in the connection location 3. The radial gap 11 is sized such that the gas encounters an adequate flow channel. The mean width of the radial gap 11 lies in the range of 2% to 20% of the diameter of the gas flasks or cartridges 6.

The gas flasks or cartridges 6 are partially filled with liquid gas. As gas is withdrawn, latent heat of evaporation is required and is extracted from the environment. The gas flowing out of the gas flasks or cartridges 6 can be heated in the relatively narrow radial gap 11 on the walls 1*c* of the pressurized gas container 1 heated by ambient air before being conducted through the bore 4 to the point of gas consumption. The pressurized gas container 1 can, for this purpose, comprise a material of high thermal conductivity and high specific heat, for instance aluminum.

Figure 3:
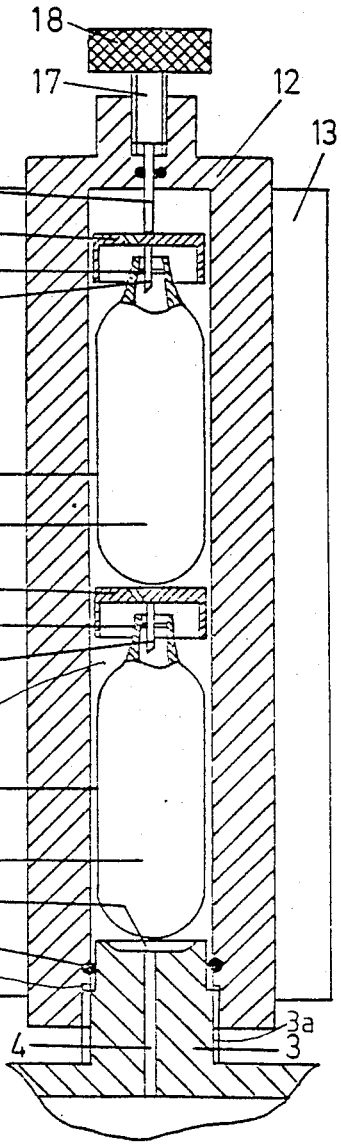
FIG. 3 shows in cross-section a gas supply device having a mechanical tightening device for two gas flasks.

FIG. 3 shows a further pressurized gas container 12 constructed especially for heating the gas flowing through the radial gap 11 and, of course, also for accommodating the gas flasks or cartridges 6. This pressurized gas container 12 is made of, for instance, aluminum and is provided with ribs or fins 13. The mass of the pressurized gas container 12 is more than seven times higher than the mass of the gas storable in both gas flasks or cartridges 6. The stored heat ensures that the temperature and therefore the pressure remains practically constant during the entire operational period of the gas supply device. The ribs or fins 13 absorb a relatively great amount of heat from the environment with their large surface areas and conduct this heat to the inner layers of the pressurized gas container 12. The surface of the pressurized gas container 12 exposed to air or sweepable by air, including the ribs or fins 13, comprises more than 20 square centimeters per gram of the gas stored in both gas flasks or cartridges 6. By this measure a good extraction of heat from ambient air is ensured even during the operational period. During recharging of the gas supply device with fresh gas flasks or cartridges, the relatively great exterior surface of the pressurized gas container 12 shortens the waiting period until the next state of operational readiness, since the pressurized gas container 12 can assume the ambient temperature relatively rapidly.

The initiation or establishment of operational readiness for the arrangement according to FIG. 3 begins with the pressurized gas container 12 unscrewed and empty. First an opening device 15 provided with a pin or needle 14 is inserted into the pressurized gas container 12, then a gas flask or cartridge 6, then another opening device 15 and another gas flask or cartridge 6. The pressurized gas container 12 thus prepared is subsequently screwed onto the connection location 3 until the first pin or needle 14 punctures the first closure membrane 7.

At this moment an increased pressure arises in the interior space 12*b* of the pressurized gas container 12 which causes high friction forces in the threaded connection 3*a*, 12*a* between the pressurized gas container 12 and the connection location 3. In order to be able to introduce the second pin or needle 14 into the second closure membrane 7 with a low physical effort, an adjustment screw 17 provided with a gas-tightly introduced plunger 16 is provided on the end of the pressurized gas container 12 remote from the connection location 3. The adjustment screw 17 can be turned-in by turning a knob 18, which pushes the gas flasks or cartridges 6 the pressurized gas container 12 together and causes the second pin or needle 14 to puncture the second closure membrane 7.

Figure 4:
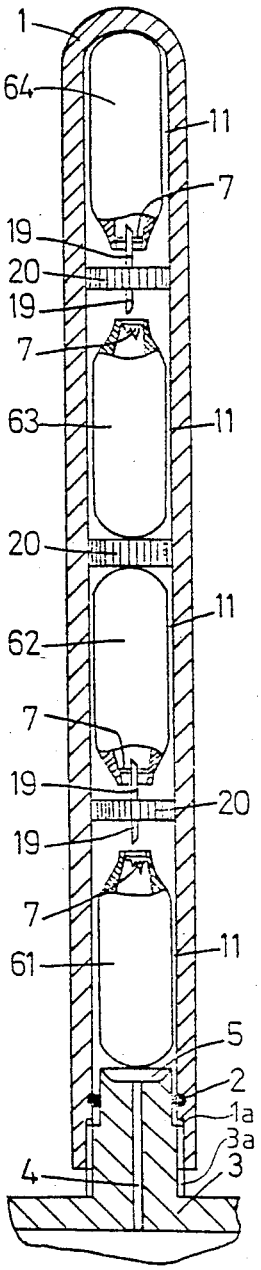
FIG. 4 schematically shows in cross-section a gas supply device having four gas flasks and opening devices actuatable by gas pressure after opening of the first gas flask.

In the gas supply device shown in the operational position in FIG. 4, the same components already described in relation to FIG. 1 have the same reference characters. This arrangement differs from that shown in FIG. 1 in that a tightening device comprising two partial tightening devices acting in temporal sequence is provided. The first partial tightening device comprises the fastening or connection means 1*a*, 3*a* of the pressurized gas container 1 to the connection location 3 and is effective only until the first closure membrane 7 is punctured by a pin or needle 19 when screwing on the pressurized gas container 1.

At this moment the pressure in the gas space or chamber of the opened gas flask or cartridge increases, for instance in the space surrounding the gas flask or cartridge 61. The gas spaces or chambers of the individual gas flasks or cartridges 61, 62, 63 and 64 are separated from one another by semi-sealing pistons 20 translatable in the pressurized gas container 1. The semi-sealing pistons 20 are provided with knurling or with serrations so that they represent only an insignificant throttling location for gas flow in the operational position. The semi-sealing pistons 20 arranged between the ends provided with an openable closure membrane 7 of the gas flasks or cartridges 61, 62 and 63, 64 carry pins or needles 19 and serve as opening devices.

Figure 5:
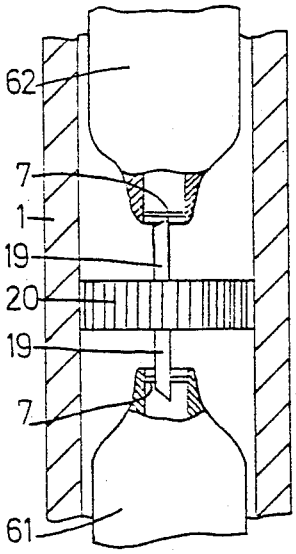
FIG. 5 schematically shows an associated opening device while the first gas flask is being opened.
Figure 6:
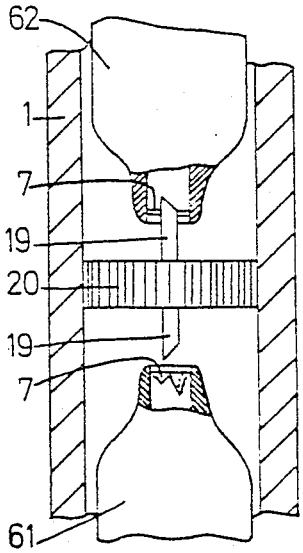
FIG. 6 shows an associated opening device when the second or the last gas flask is being opened or in the subsequent operational position in cross-section on an enlarged scale.
Figure 7:
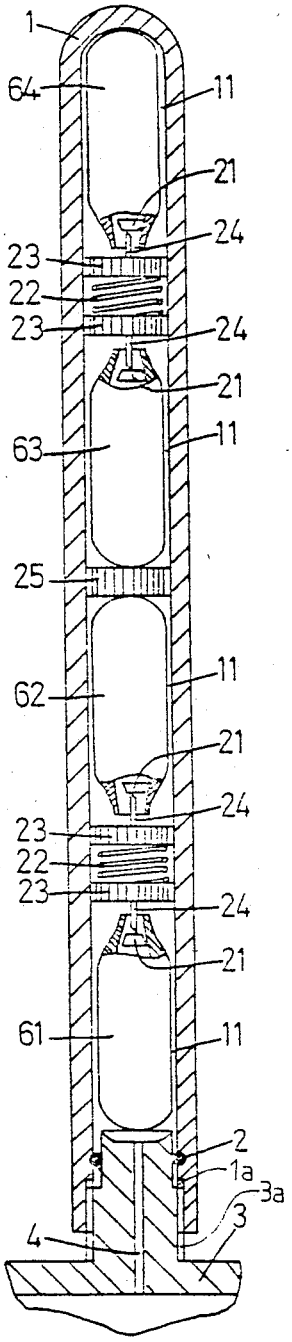
FIG. 7 schematically shows in cross-section a gas supply device having a further opening device.

The space between the gas flasks or cartridges 61 and 62 is shown on an enlarged scale in FIGS. 5 and 6. FIG. 5 illustrates the instant at which the openable closure membrane 7 of the first gas flask or cartridge 61 is punctured by the pin or needle 19 when screwing the pressurized gas container 1 onto the connection location 3. As already mentioned, the pressure in the gas space or chamber surrounding this gas flask or cartridge 61 suddenly increases and pushes the semi-sealing piston 20 toward the next gas flask or cartridge 62. The pin or needle 19 penetrates the closure membrane 7 of this gas flask or cartridge 62 which causes a sudden pressure increase in its surrounding gas space or chamber, as shown in FIG. 6. This pressure drives the next semi-sealing piston 20 so far that the third gas flask or cartridge 63 and subsequently the fourth are opened. FIG. 6 shows the position of the semi-sealing piston 20 between the gas flask or cartridges 61 and 62 when perforating the second closure membrane 7 or, equivalently, in the subsequent operational position.

The arrangement described in relation to FIG. 4 is only suitable for gas flasks or cartridges closed by a closure membrane 7. FIGS. 7, 8, 9 and 10 show a gas supply device which is suitable for the employment of gas flasks or cartridges having a closure valve which can be pressed open as well as for gas flasks or cartridges having a closure membrane. In this arrangement two semi-sealing pistons 23 spaced apart by a spring 22 and guided in the pressurized gas container 1 are arranged between the mutually confronting ends of gas flasks or cartridges 61, 62 and 63, 64 which are provided with a closure valve 21 which can be pushed open. These semi-sealing pistons 23 carry pins or needles 24 on their sides remote from the spring 22. These pins or needles 24 are provided for either pushing open closure valves 21 or for puncturing closure membranes 7. A single semi-sealing piston 25 is inserted at the further abutting location of the gas flasks or cartridges 62 and 63.

Figure 8:
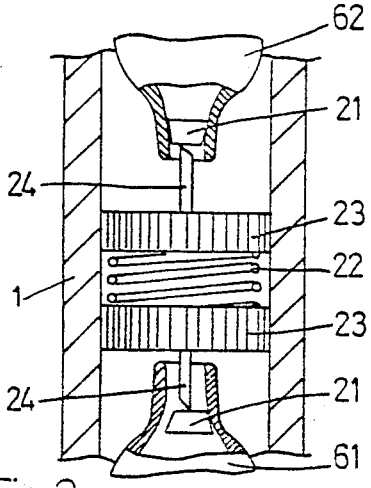
FIG. 8 schematically shows an associated opening device when the first gas flask is being opened.

The filling operation of the unscrewed and empty pressurized gas container 1 is performed in the sequence of inserting a gas flask or cartridge 64, an assembly of two semi-sealing pistons 23 and a spring 22, then another gas flask or cartridge 63, a single semi-sealing piston 25, a gas flask or cartridge 62, another assembly of two semi-sealing pistons 23 and a spring 22 and finally a gas flask or cartridge 61. The pressurized gas container 1 thus filled is screwed onto the connection location 3, pressing together the two springs 22 so far that a first gas flask or cartridge, for instance the gas flask or cartridge 61, is opened by the pin or needle 24. This state at the location between the gas flasks or cartridges 61 and 62 is shown in FIG. 8 on an enlarged scale.

Figure 9:
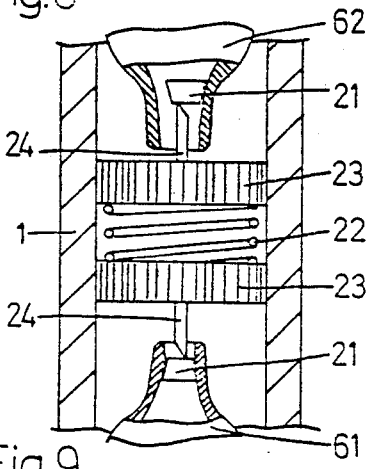
FIG. 9 schematically shows an associated opening device when a further gas flask is being opened.

When the first closure valve 21 is opened, gas flows out of the gas flask or cartridge 61 and pushes both semi-sealing pistons 23 toward the gas flask or cartridge 62. During this pushing or translation, the spring 22 cannot yet relax so that the closure valve 21 in the gas flask or cartridge 61 is closed again and the closure valve 21 in the gas flask or cartridge 62 is opened, as is shown in FIG. 9.

Figure 10:
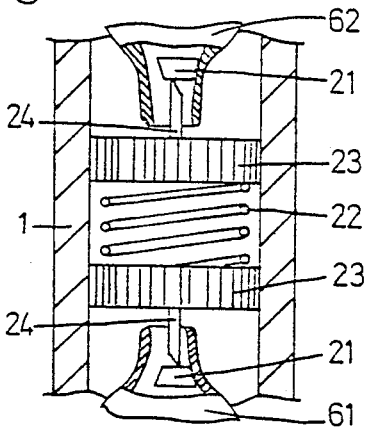
FIG. 10 schematically shows an associated opening device in the operational position in cross section and at another scale.

At this moment the piston 25 and therefore also the gas flask or cartridge 63 is pushed further under the effect of the gas escaping from the gas flask or cartridge 62 until the closure valve 21 in the gas flask or cartridge 63 opens. Subsequently, the second assembly of two semi-sealing pistons 23 and a spring 22 translates so far that the fourth gas flask or cartridge 64 is opened. When all four gas flasks or cartridges 61, 62, 63 and 64 have been opened at least once, approximately the same pressure prevails in the associated gas spaces or chambers so that both springs 22 can relax or expand again. When the spring 22 relaxes, the neighboring semi-sealing pistons 23 are pushed apart and the pins or needles 24 push all closure valves 21 open. This state of operation is shown in FIG. 10.

Figure 11:
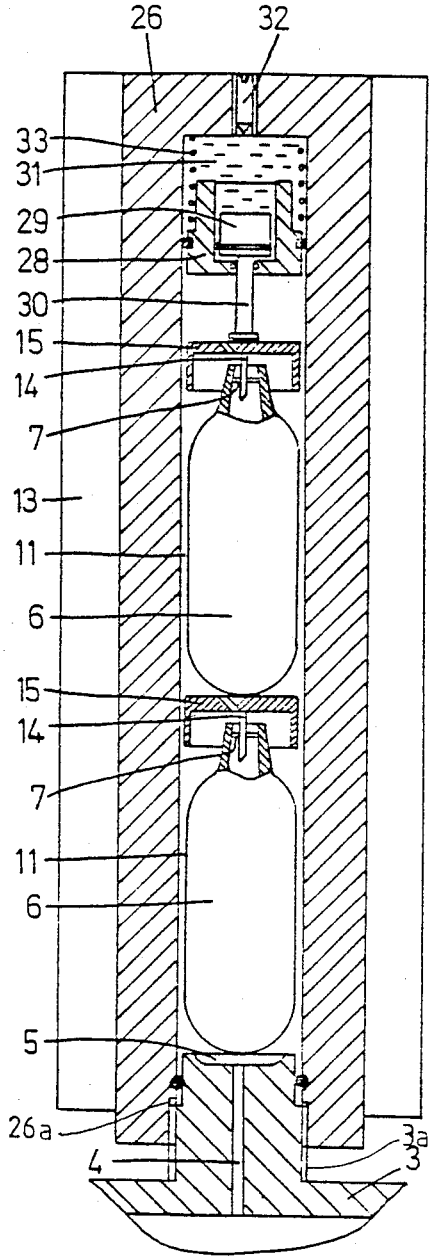
FIG. 11 schematically shows in cross-section a gas supply device having two gas flasks and a tightening device effective after the first gas flask has been opened.

FIG. 11 shows a modification of the arrangement shown in FIG. 3. The same components have the same reference characters. The tightening device here comprises two partial tightening devices. Once again, the fastening or connection means 3*a*, 26*a* of a pressurized gas container 26 serves as the first partial tightening device. When the pressurized gas container 26 is screwed on, this first partial tightening device 3*a*, 26*a* is effective until the first gas flask or cartridge 6 is opened by one of the pins or needles 14.

Figure 12:
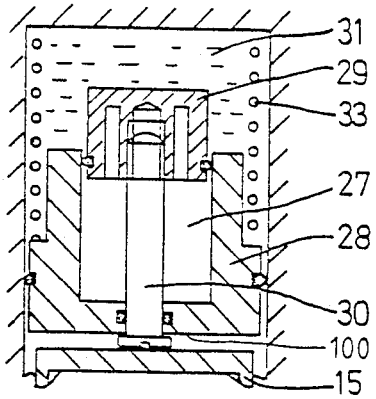
FIGS. 12, 13 and 14 schematically show in cross-section three positions of this tightening device.
Figure 13:
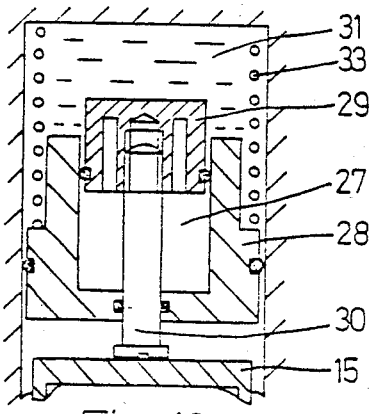
Figure 14:
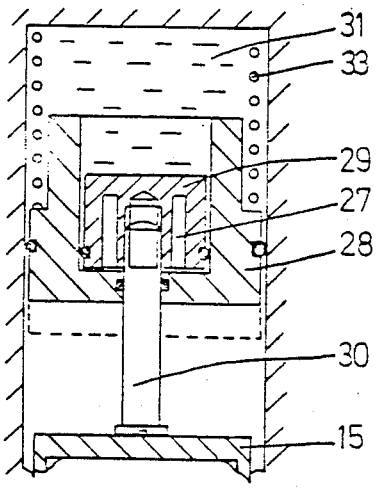

The second partial tightening device, which is set into operation by the pressure increase in the pressurized gas container 26 when gas escapes from the first-opened gas flask or cartridge 6, contains a gas-tightly sealed space 27 filled with a compressible medium, e.g. air, and which is shown in the FIGS. 12, 13 and 14 in section on an enlarged scale. This space 27 is situated within a larger piston 28 which is gas and liquid-tightly guided in the closed end region of the pressurized gas container 26 and is closed off by a smaller piston 29 which is in turn gas and liquid-tightly guided therein. The larger piston 28 closes off the gas space or chamber of the pressurized gas container 26 with its end face.

The smaller piston 29 is provided with hollow spaces or voids in order that the smaller piston 29 can be guided up to the end position shown in FIG. 14. In this end position, the compressible medium is situated in the void of the smaller piston 29. This smaller piston 29 is provided with a plunger 30 which is gas-tightly guided out of the cylinder space 27 on its side remote from the closed end region of the pressurized gas container 26. The plunger 30 comprises a considerably smaller diameter than the cylinder formed in the large piston 28 and contacts the opening device 15 with its end protruding from the larger piston 28.

The space 31 lying between the closed end region of the pressurized gas container 26 and both piston surfaces confronting this end region is filled with an incompressible fluid, e.g. water. This fluid can be filled through an opening 32 provided with a sealed set-screw or threaded plug. A spring 33 assists in returning the larger piston 28 into its idle position.

When initiating operational readiness, an opening device 15, a gas flask or cartridge 6, then an opening device 15 and another gas flask or cartridge 6 are inserted in sequence into the unscrewed pressurized gas container 26. The position of the plunger 30 in the pressurized gas container 26 is shown in FIG. 12. Now the pressurized gas container 26 is screwed onto the connection location 3 so far that a pin or needle 14 punctures or perforates the first closure membrane 7 or, for gas flasks or cartridges having a closure valve, pushes open a closure valve 21.

At this moment the pressure in the pressurized gas container 26 increases and presses the larger piston 28 toward the closed end region of the pressurized gas container 26, as shown in FIG. 13. The fluid filled into the space 31 assumes the pressure acting on the rear side of the larger piston 28 and pushes the smaller piston 29 into the cylinder formed in the larger piston 28. This compresses the compressible medium in the space 27 and presses the plunger 30 onto the opening device 15. This procedure continues until the smaller piston 29 attains the end position illustrated in FIG. 14.

In this position, the plunger 30 is fully extended and all gas flasks or cartridges 6 are open. The gas can now be extracted from the gas supply device and operational readiness is established. When the stored gas is exhausted, the pressure in the pressurized gas container 26 drops, which causes the larger piston 28 to return to the position illustrated in FIG. 12 under the action of the spring 33 and the compressible medium expanding in the space 27. The smaller piston 29 immerses in the fluid situated in the space 31 and withdraws the plunger 30 to the stop 100 defined by the lower face of the larger piston.

Figure 15:
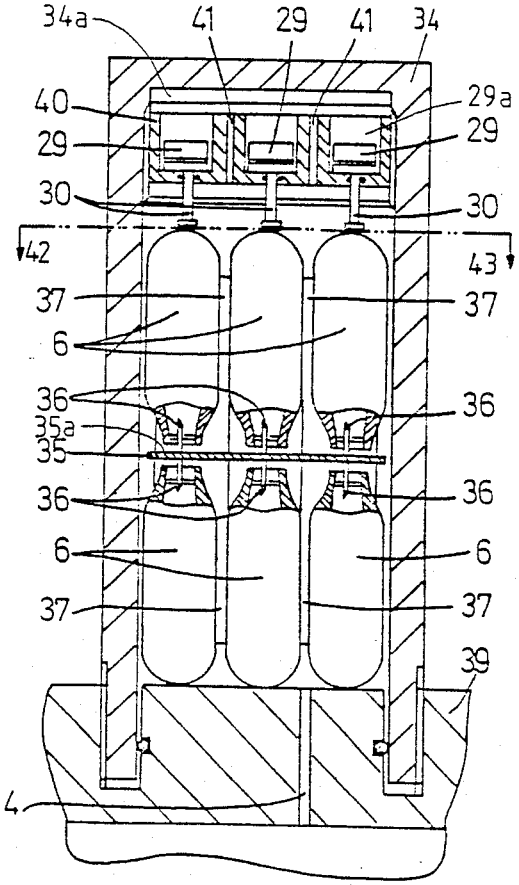
FIG. 15 schematically shows a side view of a further gas supply device having gas flasks arranged in pairs in longitudinal alignment and also laterally adjacent to one another.
Figure 16:
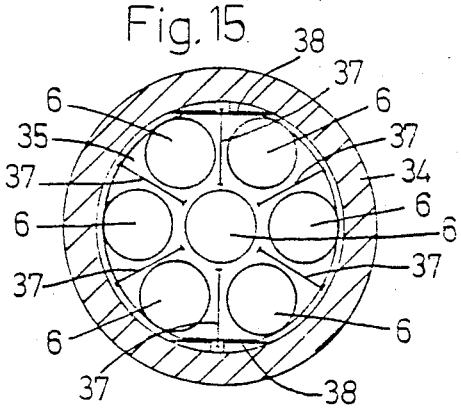
FIG. 16 schematically shows a plan view taken along the line 42–43 in FIG. 15.

A gas supply device having fourteen gas flasks or cartridges 6 accommodated in a pressurized gas container 34 is illustrated in FIGS. 15 and 16. An opening device 35 comprises a plate 35*a* provided with pins or needles 36 on both sides and with walls 37 extending substantially perpendicular to the plate 35*a* for guiding the gas flasks or cartridges 6. The plate 35*a* is flattened at two mutually opposite locations and is guided in the pressurized gas container 34 in non-rotatable, properly oriented manner by built-in members or flats 38. A plate 40 provided with cylinders 29*a* for the pistons 29 is non-rotatably screwed into the gas-tightly sealed end region of the pressurized gas container 34 remote from the connection location 39. The plate 40 is provided with bores 41.

The initiation of operational readiness for this gas supply device begins with the pressurized gas container 34 empty and unscrewed. Gas flasks or cartridges 6 are inserted between the walls 37 existing on the opening device 35. The thus loaded opening device 35 is pushed into the pressurized gas container 34 in the proper position or orientation determined by the built-in members or flats 38. Subsequently, the pressurized gas container 34 is screwed onto the connection location 39 provided with the bore 4 leading to the gas consumption point so far that a pin or needle 36 opens one of the gas flasks or cartridges 6.

At this moment the pressure in the pressurized gas container 34 suddenly increases. The pressure is also increased in the space 34*a* lying between the closed end region of the pressurized gas container 34 and the plate 40 through the bores 41 fashioned in the plate 40. The pressure increase in this space 34*a* presses the pistons 29 gas-tightly guided in the cylinders 29*a* formed on the plate 40 into the cylinder space, which compresses the compressible medium situated in the cylinder space.

The pistons 29 are identical to those shown in FIGS. 12, 13 and 14. The difference to the arrangements of FIGS. 12, 13 and 14 consists in that the cylinders 29*a* containing a compressible medium are formed in the plate 40 which is firmly connected with the pressurized gas container 34 and not in a larger piston 28, as well as in that the space 34*a* between the closed end region of the pressurized gas container 34 and the plate 40 communicates with the gas space or chamber of the pressurized gas container 34 and does not contain any liquid.

When the pressure increases in the gas space or chamber of the pressurized gas container 34 after opening the first gas flask or cartridge 6, the plungers 30 associated with the upper gas flasks or cartridges 6 are extended in an analogous manner to FIGS. 12, 13 and 14 and cause all gas flasks or cartridges 6 to be opened until the end position illustrated in FIG. 14 is attained with certainty.

After exhaustion of the gas stored in the fourteen gas flasks or cartridges 6, pressure in the pressurized gas container 34 drops, the compressible medium trapped in the cylinder space 29*a* ahead of the piston 29 expands again and draws the plungers 30 back into the plate 40. Reloading of the pressurized gas container can now be undertaken.

While there are shown and described present preferred embodiments of the invention, it is to be distinctly understood that the invention is not limited thereto, but may be otherwise variously embodied and practiced within the scope of the following claims. Accordingly,

What I claim is:

1. A gas supply device, comprising:

a pressurized gas container having an interior space and an operational position;

a connection location for said pressurized gas container;

a plurality of gas flasks inserted into said pressurized gas container;

hermetic means for gas-tightly connecting said pressurized gas container to said connection location when said pressurized gas container is in said operational position;

each gas flask of said plurality of gas flasks having an interior space conmunicating with said interior space of said pressurized gas container through a small aperture serving as a throttling orifice;

each said gas flask being pressure-resistant and partially filled with a liquid gas before being inserted into said pressurized gas container;

an openable closure component for closing each said gas flask;

an opening device associated with each said openable closure component and effective at initiation of a state of operational readiness of the gas supply device when said pressurized gas container is connected and gas-tightly sealed to said connection location;

at least one of said opening devices being structured to open a therewith associated one of said openable closure components under the influence of an external force;

a tightening device installed in said pressurized gas container for pushing said plurality of gas flasks conjointly with at least one said opening device together when a state of operational readiness of the gas supply device is to be established;

said tightening device comprising two partial tightening devices structured to act in temporal sequence such that a first partial tightening device of said two partial tightening devices is capable of opening a first-to-be-opened gas flask of said plurality of gas flasks while remaining gas flasks of said plurality of gas flasks remain closed;

said first partial tightening device being structured to be effective only until said openable closure component of said first-to-be-opened gas flask is open;

a second partial tightening device of said two partial tightening devices being structured to be effective until said openable closure components of said remaining gas flasks are open;

said first partial tightening device being externally actuatable under the influence of an external force;

said second partial tightening device being actuatable by said gas escaping from said first-to-be-opened gas flask; and said first partial tightening device defining said connecting means for connecting said gas container to said connection location.

2. The gas supply device as defined in claim 1, wherein:

said pressurized gas container is substantially tubular;

said plurality of gas flasks being inserted into said pressurized gas container in a mutually tandem relationship with a radial gap between said pressurized gas container and each gas flask of said plurality of gas flasks;

said openable closure component being openable by puncturing;

said second partial tightening device comprising semi-sealing pistons translatably guided in said pressurized gas container and separatingly defining individual gas chambers therein;

each semi-sealing piston of said semi-sealing pistons having at least one predetermined piston surface immediately confronting said openable closure component of an associated one of said gas flask; and said at least one predetermined piston surface being provided with at least one opening needle for puncturing said openable closure component.

3. The gas supply device as defined in claim 1, wherein:

said pressurized gas container is substantially tubular;

said plurality of gas flasks being inserted into said pressurized gas container in a mutually tandem relationship;

said plurality of gas flasks being inserted into said pressurized gas container in a mutually tandem relationship with a radial gap between said pressurized gas container and each gas flask of said plurality of gas flasks;

said plurality of gas flasks including at least one ordinally odd-numbered gas flask counted in a direction extending substantially away from said connection location;

said plurality of gas flasks including at least one ordinally even-numbered gas flask counted in said direction extending substantially away from said connection location;

said at least one ordinally odd-numbered gas flask having a predetermined end for accommodating said openable closure component thereof;

said at least one ordinally even-numbered gas flask having a predetermined end for accommodating said openable closure component thereof;

at least two mutually adjacent gas flasks of said at least one ordinally odd-numbered gas flask and said at least one ordinally even-numbered gas flask being oriented within said mutually tandem relationship such that said predetermined ends thereof mutually confront one another in paired relationship;

two semi-sealing pistons being inserted between said mutually confronting predetermined ends of said at least two mutually adjacent gas flasks;

a spring for maintaining said two semi-sealing pistons in a mutually spaced relationship;

each semi-sealing piston of said two semi-sealing pistons having at least one predetermined side remote from said spring;

said at least one predetermined side remote from said spring supporting an opening pin;

said two semi-sealing pistons being translatably guided in said substantially tubular pressurized gas container;

said gas flasks defining other abutting locations at which they also mutually abut; and a single semi-sealing piston being inserted at each of said other abutting locations.

4. The gas supply device as defined in claim 3, wherein:

said two semi-sealing pistons in said mutually spaced relationship define an intermediate space therebetween; and said opening pin is hollow and opens into said intermediate space.

5. The gas supply device as defined in claim 1, wherein:

said second partial tightening device comprises a hermetically sealed space arranged in said interior space of said pressurized gas container;

said hermetically sealed space being hermetically sealed by a wall member;

at least a portion of said wall member being constructed to yield in relation to other portions of said wall member under the influence of a pressure variation within said interior space of said pressurized gas container;

a compressible medium filling said hermetically sealed space;

said wall member being partially supported by said pressurized gas container;

said wall member defining a predetermined direction extending toward said plurality of gas flasks and said opening devices; and said yieldable portion of said wall member being constructed to move in said predetermined direction under the influence of a pressure rise in said pressurized gas container and to effect a mutual approach of said opening devices.

6. The gas supply device as defined in claim 5, wherein:

said pressurized gas container has a closed end region;

a larger piston being gas and liquid-tightly guided within said pressurized gas container in said closed end region thereof;

said wall member comprising a cylinder formed within said larger piston;

said cylinder comprising an internal space;

said yieldable portion of said wall member comprising a smaller piston gas and liquid-tightly guided within said cylinder;

said smaller piston having at least one predetermined side remote from said closed end region of said pressurized gas container;

said smaller piston being provided with a plunger on said at least one predetermined side thereof;

said plunger being gas-tightly guided out of said internal space of said cylinder;

said plunger being intended for pushing together said plurality of gas flasks and said opening devices;

said plunger having a predetermined first diameter;

said internal space of said cylinder having a predetermined second diameter;

said first diameter being considerably smaller than said second diameter;

two piston surfaces of said larger and smaller pistons confronting said closed end region of said pressurized gas container;

an intermediate space lying between said closed end region of said pressurized gas container and said two piston surfaces; and an incompressible fluid filling said intermediate space.

7. The gas supply device as defined in claim 1, wherein:

said pressurized gas container comprises a material of high thermal conductivity and of high specific heat.

8. The gas supply device as defined in claim 7, wherein:

said material is aluminum.

9. The gas supply device as defined in claim 1, wherein:

said pressurized gas container has a first mass;

the gas storable in said plurality of gas flasks has a second mass; and the gas supply device being constructed such that said first mass is at least seven times greater than said second mass.

10. The gas supply device as defined in claim 1, wherein:

said pressurized gas container has an external surface; and fins being provided on said external surface.

11. The gas supply device as defined in claim 10, wherein:

said pressurized gas container has a surface area exposed to air flow;

said surface area exposed to air flow including said fins; and said surface area exposed to air flow comprising at least twenty square centimeters per gram of gas storable in said plurality of gas flasks.

12. The gas supply device as defined in claim 1, wherein:

said pressurized gas container is substantially tubular; and said plurality of gas flasks being inserted into said pressurized gas container in a mutually tandem relationship with a radial gap between said pressurized gas container and each said gas flask.

13. The gas supply device as defined in claim 12, wherein:

each said gas flask has a predetermined diameter;

said radial gap having a mean width; and said mean width comprising between 2% and 20% of said predetermined diameter.

14. The gas supply device as defined in claim 12, wherein:

a first gas flask of said plurality of gas flasks is closer to said connection location than other gas flasks of said plurality of gas flasks within said mutually tandem relationship;

said first gas flask having a predetermined end accommodating said openable closure component; and said first gas flask being oriented within said mutually tandem relationship such that said predetermined end is remote from said connection location.

15. The gas supply device as defined in claim 12, wherein:

said plurality of gas flasks includes at least one ordinally odd-numbered gas flask counted in a direction extending substantially away from said connection location;

said plurality of gas flasks including at least one ordinally even-numbered gas flask counted in said direction extending substantially away from said connection location;

said at least one ordinally odd-numbered gas flask having a predetermined end for accommodating said openable closure component thereof;

said at least one ordinally even-numbered gas flask having a predetermined end for accommodating said openable closure component thereof;

at least two mutually adjacent gas flasks of said at least one ordinally odd-numbered gas flask and said at least one ordinally even-numbered gas flask being oriented within said mutually tandem relationship such that said predetermined ends thereof mutually confront one another in paired relationship.

16. The gas supply device as defined in claim 15, wherein:

said opening device has two predetermined sides;

said opening device being provided with at least one opening pin on each side of said two predetermined sides; and said opening device being arranged between said mutually confronting predetermined ends of said at least two mutually adjacent gas flasks.

17. The gas supply device as defined in claim 1, wherein:

at least two gas flasks of said plurality of gas flasks are inserted into said pressurized gas container in at least mutually laterally adjacent relationship.

18. The gas supply device as defined in claim 1, wherein:

at least two pairs of gas flasks of said plurality of gas flasks are inserted into said pressurized gas container in mutually laterally adjacent relationship;

each pair of said at least two pairs of gas flasks comprising two gas flasks of said plurality of gas flasks arranged in axially aligned relationship;

each gas flask of said two gas flasks having a predetermined end for accommodating said openable closure component; and each said gas flask of at least one pair of said at least two pairs of gas flasks being oriented within said at least one pair such that said predetermined ends thereof mutually confront one another.

19. The gas supply device as defined in claim 18, wherein:

said opening device has two predetermined sides;

said opening device being provided with at least one opening pin on each side of said two predetermined sides; and said opening device being arranged between said mutually confronting predetermined ends of said at least one pair of gas flasks.

20. The gas supply device as defined in claim 1, wherein:

said opening device is translatably inserted into said pressurized gas container and is provided with at least one opening pin.

* * * * *